United States Patent [19]

Willot

[11] Patent Number: 4,561,415

[45] Date of Patent: Dec. 31, 1985

[54] APPARATUS FOR PROFILING AN ABRASIVE MILLSTONE

[75] Inventor: Henri Willot, Glabais, Belgium

[73] Assignee: Societe de Recherches et de Developpement Industriel S.A., Glabais, Belgium

[21] Appl. No.: 559,113

[22] Filed: Dec. 7, 1983

[30] Foreign Application Priority Data

Dec. 14, 1982 [BE] Belgium ..... 0/209730

[51] Int. Cl.[4] ..... B24B 53/12

[52] U.S. Cl. ..... 125/11 R; 125/11 N; 29/568; 408/35; 51/165.71

[58] Field of Search ..... 125/11 R, 11 N; 51/165.71; 408/35; 29/26 A, 568

[56] References Cited

U.S. PATENT DOCUMENTS 1,461,755 7/1923 Cox ..... 408/35

2,587,172 2/1952 Koebel ..... 125/11 N 3,413,702 12/1968 Burg ..... 408/35

3,999,769 12/1976 Bayer ..... 408/35

4,274,231 6/1981 Verega ..... 51/165.71

FOREIGN PATENT DOCUMENTS 916294 1/1963 United Kingdom ..... 125/11 N

*Primary Examiner*—Harold D. Whitehead

*Attorney, Agent, or Firm*—Sughrue, Mion, Zinn, Macpeak and Seas

[57] ABSTRACT

This invention relates to an apparatus for profiling, truing or dressing, with precision, an abrasive millstone, by cutting using diamond tools.

The apparatus comprises a truing head 15 consisting of a cylinder 16 which is provided with a series of separate retractable diamond tools 17, each of which is capable of being regidly locked opposite the truing station of the millstone.

4 Claims, 7 Drawing Figures

APPARATUS FOR PROFILING AN ABRASIVE MILLSTONE

BACKGROUND OF THE INVENTION

This invention relates to an apparatus for profiling, truing or dressing with precision a millstone which is agglomerated with abrasives, by cutting using separate diamond profiling tools. This apparatus may be mounted on the grinding head or possibly on the work table of a grinder, whatever the grinding functions of the latter.

In particular, this invention relates to an apparatus which makes it possible to true an abrasive millstone precisely and rapidly, along difficult and precise contours, the purpose of this millstone being to ensure a perfect finishing work by grinding parts which are machined by means of a planer, a shaper, a mortising machine, a milling machine or a lathe, while correcting an allowance which is provided during machining in order to counter-balance any possible deformations which would entail a subsequent thermal or chemical treatment of the part which has been machined, for example a tempering or cementing treatment of said part.

Apparatuses are known for profiling an abrasive millstone by means of profiling diamonds supported by two separate truing arms of a two-position turret, one of the diamonds being to rough-shape the profile of the millstone, and the other to finish this profile. These known apparatuses may be mounted on a spindle frame of a grinder.

The use of pivoting truing arms makes it possible to correctly select the diamond cutting tool which is suitable for each operation, for example for the rough-shaping of the millstone profile, while leaving an adequate allowance to absorb the surface irregularities caused by the chattering of the millstone. This division of the truing of the millstone into two stages makes it possible to reduce the truing time and to prolong the life of the diamond cutting tools.

However, a major disadvantage of pivoting truing arms is that they have a considerable overhang. This overhang presents quite a substantial obstacle to ensuring a positioning, without clearance, and a precise guidance of each of the diamond tools.

Moreover, these pivoting arms require the presence of a turret slide which is either to slide directly on the bench, or on an intermediate bed plate. In some recent machine tools, such as described in U.S. Pat. No. 2,587,172, the various positions of the turret are not determined by longitudinal and transverse stops, but by microswitches which are connected to a relay system, making it possible to fix all the sources and the sequence of operations.

The advance and translation mechanisms of the truing arms carried by the turret which is mounted on the turret slide are controlled by hydraulic means and are activated in response to a profiling and truing command which is transmitted by a feeler needle passing through a gauge, and by a pantograph system. The transmission ratio is generally one tenth or one fifth with respect to the gauge. Measuring instruments which are formed, for example from a control balance and a comparator make it possible for the diamonds to be adjusted with respect to the axis of rotation of the abrasive millstone.

However, these known profiling apparatuses which have a gauge do not allow the production of profiles having sharp edges.

These known apparatuses suffer from a second disadvantage. They have only two truing tools which are oriented in the same direction. This drawback is also found in dressing apparatus when an abrasive millstone is dressed with cubic boron nitride. The binder must be removed under carefully controlled conditions to avoid a premature baring of the hard abrasive grains. The absense of tools having different orientations simultaneously impairs the precision of machining and the life of the millstone.

SUMMARY OF THE INVENTION

An object of the present invention is to overcome the above-mentioned disadvantages and to provide a particular truing head which provides the cutting tool with an increased rigidity. This invention relates to an apparatus for profiling, truing or dressing, with precision, a millstone which is agglomerated with hard abrasives by cutting using separate profiling diamond tools, each of which is carried by a truing arm. This apparatus may be mounted on the grinding head of a grinder and it is essentially characterized in that it comprises a truing head formed by a cylinder which is provided with a number of separate retractable diamond tools, each of which is mounted so that it may slide in a seat in said cylinder which is to rotate many times, each time at an angle equal to that between two adjacent tools, and is to be locked rigidly in each position in order to successively bring, with precision and perfect reproducibility, each of the tools into a predetermined position opposite the truing station of the millstone.

According to one characteristic of this invention, each of the cutting tools is brought to the truing station by a pivoting motion of the cylinder and by translation by means of a rod and a jack ensuring the supply and the removal of the cutting tool.

Each of the cutting tools which may be straight, oblique or flat advantageously have a well determined orientation.

According to another characteristic of the present invention, the apparatus comprises a computer provided with a keyboard for the manual introduction of metric data allowing the positioning of each of the cutting tools at the reference point. A stored programme in the coupler memory may be used for the automatic generation of an operation sequence number. The incremental introduction of metric data provided by an incremental measuring apparatus allows the millstone to be formed with very high precision. The apparatus also allows a programmer to fix the sequence of the operations in an automatic cycle for series operation.

Other characteristics and details of this invention will be revealed by reading the following description of the accompanying drawings which schematically show one embodiment of the profiling apparatus according to the present invention.

BRIEF DESCRIPTION OF THE DRAWINGS

The same reference numerals in the different Figures designate identical or similar elements.

DETAILED DESCRIPTION OF THE INVENTION

Figure 1:
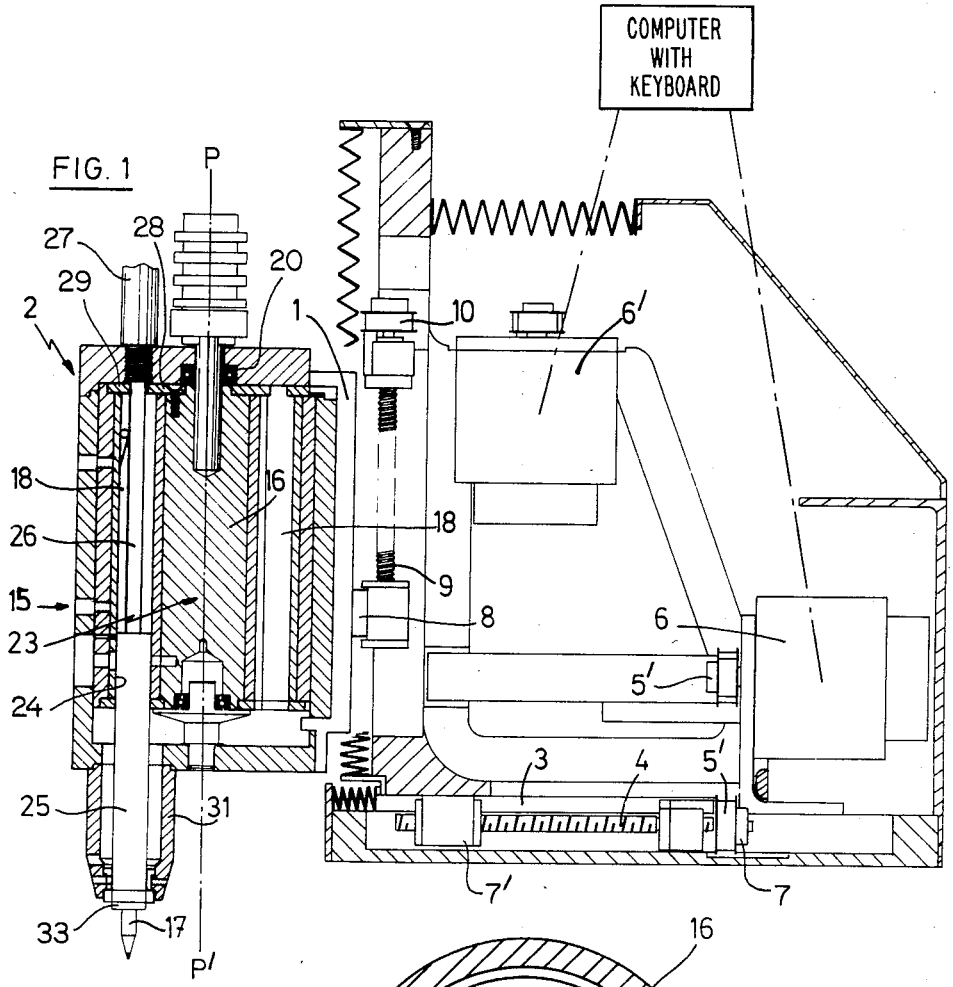
FIG. 1 is a sectional view of a profiling apparatus according to the present invention, formed from a tool holder carriage, on which a truing head is mounted.
Figure 3:
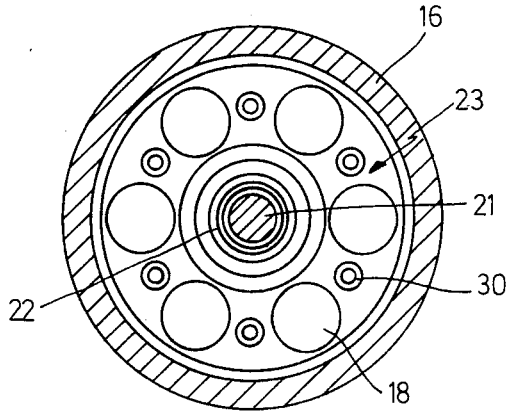
FIG. 3 is a section along line III—III in FIG. 2.
Figure 2:
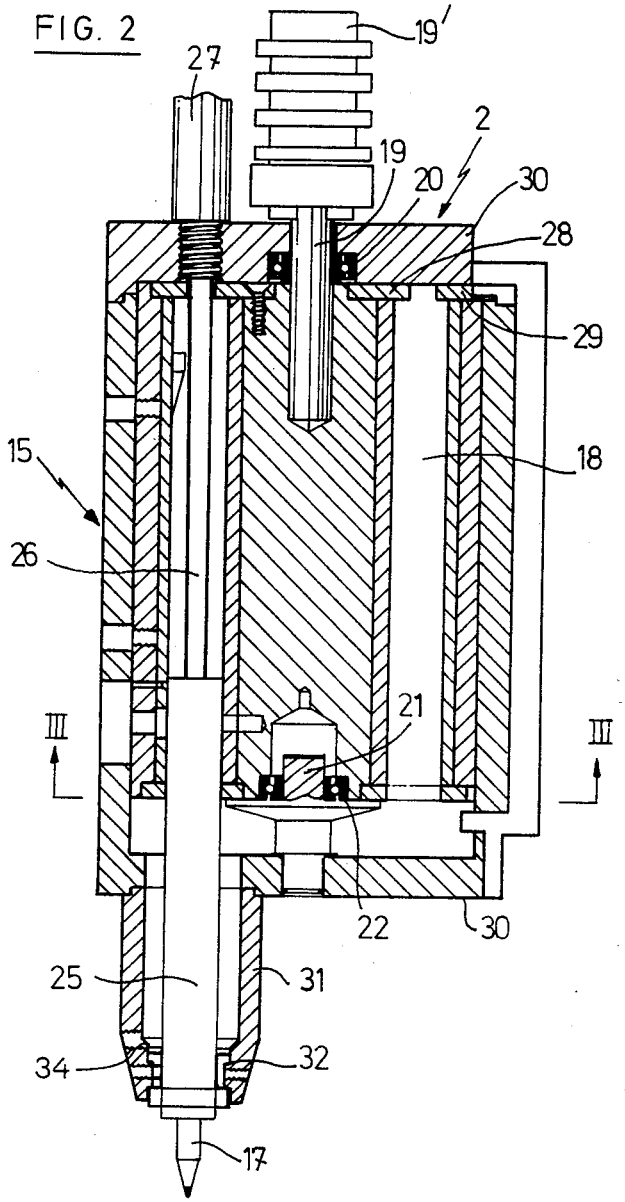
FIG. 2 is a sectional view of a first embodiment of a cylinder truing head.
Figure 4:
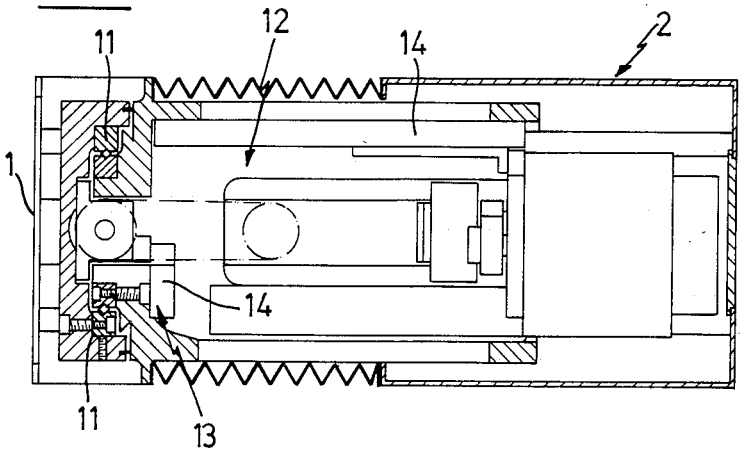
FIGS. 4 and 5 are longitudinal sections of the truing head shown in FIG. 2.
Figure 5:
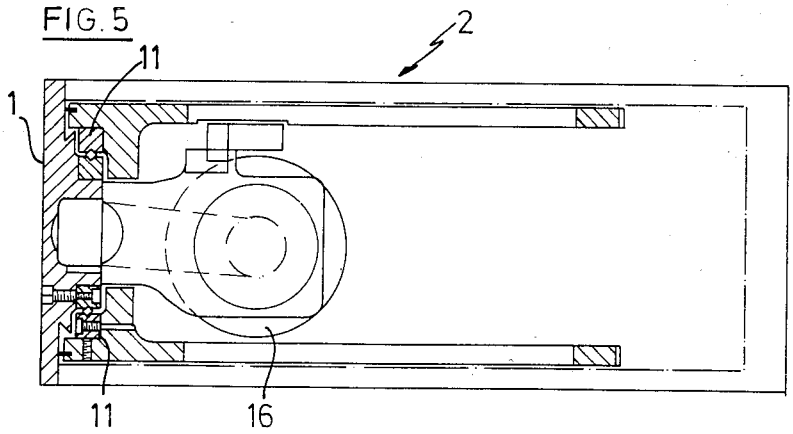

As shown in FIG. 1, a profiling apparatus according to the present invention comprises a tool holder carriage 1, on which a truing head is mounted which is designated as a whole by reference numeral 2 with six immediate indexing stations in the two directions.

The tool holder carriage 1 may be moved transversely to a work table (not shown) of a grinder, along a slide 3 by being driven by means of a ball screw 4 of the 12×2 SKF VIS TRANSROL type, controlled by a pulley 5 and an electric motor 6. The threaded shank 4 is mounted on two NADELLA 7 needle bearings of the AX 4. 10. 12 type, ensuring a mounting without clearance. The horizontal path of the tool holder carriage 1 is 75 millimeters, depending on the model.

The horizontal displacement control mechanism is designed for manual advance and automatic and micrometric advance in order to obtain a high degree of precision.

The tool holder carriage 1 may also move in a vertical plane. The vertical path, 67 millimeters long is along a second slide 8 which is perpendicular to the first slide, by being driven by means of a threaded shank 9 which is similar to the first and is controlled by a pulley 10 and an electric motor 6 which may be separate from the first. The horizontal and vertical paths of the tool holder carriage 1, are fixed by microswitches. The slides 3 and 8 are each formed by four guide rails 11.

Two closed incremental linear measuring apparatuses, having a very high degree of precision, of the HEIDE-HAIN type, which are designated as a whole by reference numerals 12 and 13 each comprise a glass incremental guide bar 14, a feeler captor or reticle head which is not shown, a lamp (not shown) emitting a series of narrow light beams consisting of photoelements which are to catch said beams and said lamp is connected to a feeler carriage.

By displacing the guide bar 14 with respect to the feeler reticle, variations in luminosity appear at the level of the photo elements which convert these luminosity variations into sinusoidal signals which are then used in the electronic counter.

The truing head 2 which is formed from a body or a casting 15 in which a cylinder 16 pivots, being provided with a series of separate and retractable diamond cutting tools 17 is mounted on the tool holder carriage 1 so that the pivoting axis P-P' of said cylinder 16 is substantially vertical. The above-mentioned cutting tools 17 are each mounted so that they may slide in a seat 18 in said cylinder 16. The cylinder 16 supports an upper shaft 19 which is mounted on the casing 15 by means of an upper bearing 20, and it is driven by pulleys 19'. The cylinder also rests on the casing 15 by means of a lower pivot 21 and a bearing 22. The cylinder 16 comprises a series 23 of seats 18, for example six seats 18 which are trapezoidal in cross section, and the walls of which have a groove 24, along which a slide block 25 may move, being activated by a rod 26 and a jack 27. Each slide block 25 carries a cutting tool 17. Each cutting tool 17 may have a different shape, adapted to the profile to be produced. The seats 18 are delimited at the top by arresting rings 28 and 29. The casing 15 is sealed at the top and at the bottom by two covers 30 which are attached by screws 30'.

A guide 31 which is integral with the casing 15 and is mounted at the level of a recess 32 in this casing 15, opposite the profiling station, and a locking device 33 make it possible to attach each of the tools onto the truing head in an adequately rigid manner.

Each of the tools 17 is positioned by repeatedly pivoting the cylinder 16 by an angle which is equal to that between two adjacent tools, in both directions. The cylinder 16 may be rigidly locked in each position in order to successively bring each of the tools 17 opposite the profiling or truing station of the millstone which is not shown. After the tools 17 have been positioned opposite the truing station by pivoting the cylinder 16, they are each introduced and removed pneumatically or hydraulically by means of the rod 26 which drives the slide block 25 enclosing the tool 17. This rod 26 brings each of the corresponding tools against a judiciously designed stop 34 of the guide 31 to ensure the locking of the tool 17 in the vicinity of the millstone. This device makes it possible to reduce any overhang of each of the cutting tools with respect to the working surface of the millstone to be profiled.

When the tool 17 is raised, the device which has been described eliminates any risk of friction and impact of the tool 17 against any part of the profile of the millstone which is not shown.

The truing head may be provided with an adjusting or positioning device consisting of three microswitches or stress gauge measuring units 49 which are located in reference planes.

Figure 6:
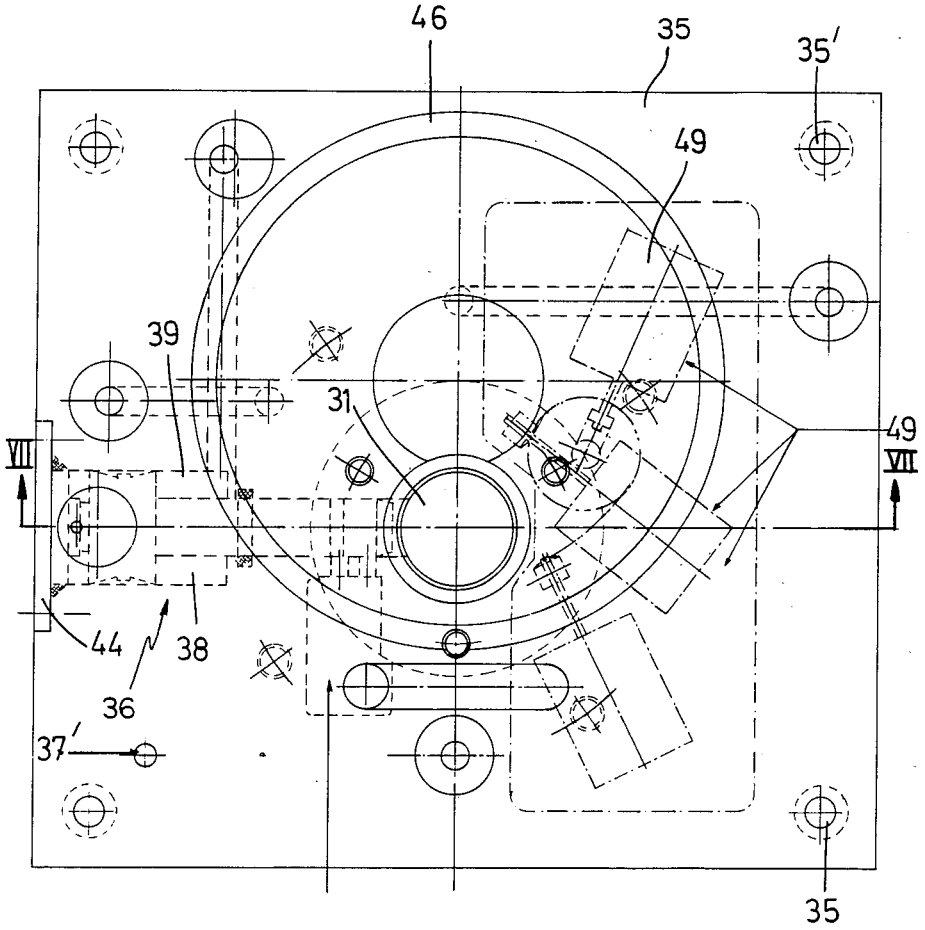
FIGS. 6 and 7 are respectively a top view and a cross-sectional view of a second embodiment of a truing head.
Figure 7:
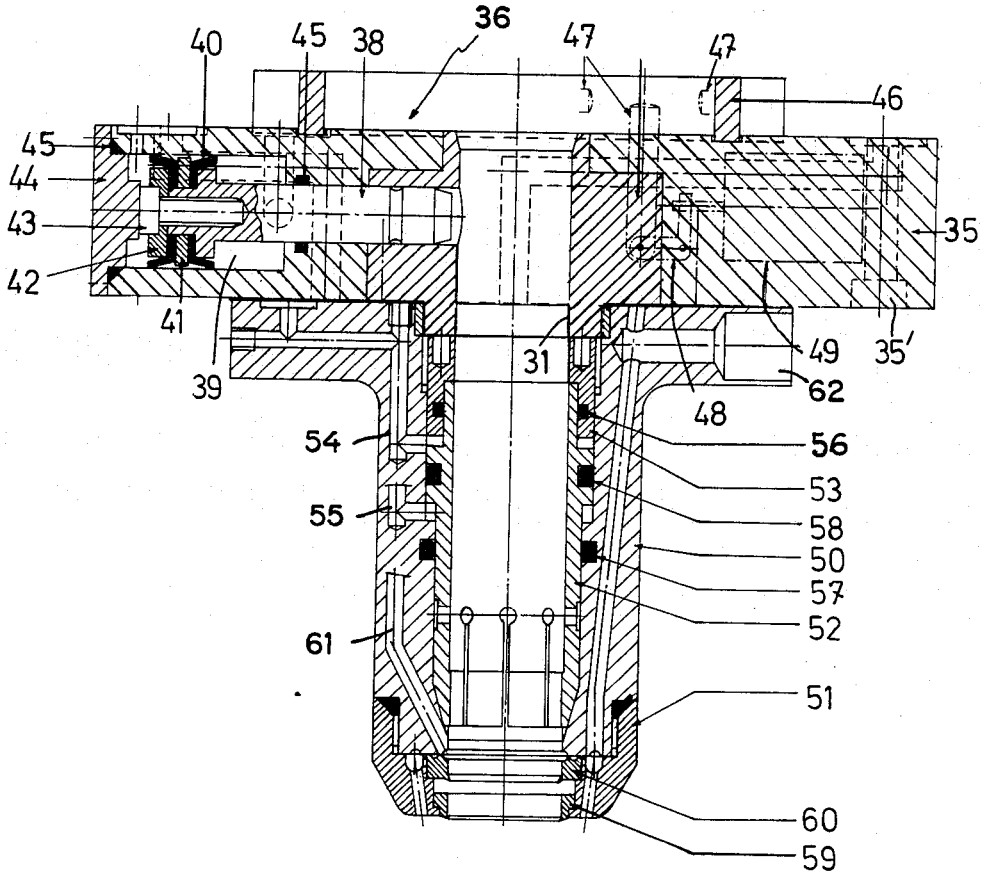

A second embodiment of a locking and adjusting device is shown in FIGS. 6 and 7. This device comprises a box 35 which is to allow the fixing and positioning of the tool loader according to the present invention, provided with a locking and adjusting device which is designated as a whole by reference numeral 36, on any profiling machine by means of gudgeon bolts 35'.

The box 35 comprises a centering ring 37 and a centering pin 37' permitting the positioning of the box. A piston rod 38 which slides transversely with respect to the axis of the guide 31 is maintained tightly in a cavity 39 by piston joints 40 which are applied against a cross piece ring 41 by means of a tightening ring 42 which is held in place by a screw 43. The cavity 39 is sealed by a cover 44 and an O ring 45.

A ring 46 permits the positioning of feelers 47 which are mounted on levers 48 controlling the microswitch measuring units 49.

The guide 31 consists of a tubular envelope 50 which is provided at its end with a calibrated cap 51 and is to hold in position a part 52 for gripping the diamond tool and to make up for any possible clearance.

The gripping part 52 slides along a guide ring 53 and the tubular envelope under the effect of a control fluid supplied by admission channels 54 and backflow channels 55, the tightness of the hydraulic or pneumatic control system being produced by O rings 56, 57 and 58. The guide ring 53 is also used as a high stop for the gripping shank 52.

The calibrated cap 51 comprises two seal rings 59 and 60, and an annular recess 61 which is to distribute a strong blast or air intended to sweep out any impurities which may lie in the mouth of the calibrated cap 51.

The tubular envelope 50 has channels 62 which are intended for a cooling fluid.

It is clear that the present invention is not restricted to said embodiments, or to the details which are given above, and that it is possible to make numerous modifications to these details, without thereby departing from the scope of the invention.

Thus, the apparatus which has just been described may be used for the preparation of an abrasive millstone. After the profiling operation, the working surface of the millstone has to be cleaned up, i.e., the binder between the abrasive grains has to be removed from the surface. One of the tools may then consist of a small serrated wheel or a bar of an appropriate shape made of soft steel.

I claim:

1. An apparatus for profiling, truing and dressing a millstone comprising a fixed head mounted in operational relationship with a grinder, said head having a housing and a cylinder rotatable about an axis within said housing, said cylinder being provided with a plurality of seats each of which contains a feed member on which is secured a cutting tool, means for rotating incrementally said cylinder such that a desired cutting tool is positioned proximate to a profiling, truing and dressing station, means for locking said cylinder in position at said station, means for moving said feed members within said seats such that a desired cutting tool is displaced from a retracted position to an extended position in contact with said millstone, and means for clamping said cutting tool in order to secure it into position with respect to said millstone.

2. The apparatus according to claim 1, wherein each of the cutting tools is brought to said station by rotation of said cylinder, by longitudinal translation of said feed member and by operation of a jack insuring the extension and the retraction of the cutting tool.

3. The apparatus of claim 1, wherein each of said cutting tools may be straight, oblique or conical.

4. The apparatus according to claim 1, further comprising a computer including a memory, said computer being provided with a keyboard for the manual introduction of data for positioning each of the cutting tools at said station, said memory including a program for automatic generation of a sequence of operations, and means for manually fixing the sequence of operations.

* * * * *